United States Patent [19]

Cremona

[11] 4,083,391

[45] Apr. 11, 1978

[54] WOOD SHEARING MACHINE FOR THE PRODUCTION OF VENEERS, HAVING THE WOOD-SUPPORTING TABLE INCLINED TO THE VERTICAL

[76] Inventor: Angelo Cremona, V.le Lombardia, 275, Monza, Italy, 20052

[21] Appl. No.: 686,661

[22] Filed: May 17, 1976

[30] Foreign Application Priority Data

May 28, 1975 Italy ..... 23803 A/75

[51] Int. Cl.[2] ..... B27C 1/00; B27L 5/06

[52] U.S. Cl. ..... 144/178; 144/162 R; 144/179

[58] Field of Search ..... 83/62, 556, 558, 915.5; 144/714 R, 175, 177, 178, 179, 209 R, 211, 212, 213, 162 R, 214

[56] References Cited

U.S. PATENT DOCUMENTS

| | | | |
|---|---|---|---|
| 74,830 | 2/1868 | Kassing | 144/179 |
| 3,441,069 | 4/1969 | Koss | 144/178 |
| 3,680,612 | 8/1972 | Hale | 144/178 |

*Primary Examiner*—Othell M. Simpson
*Assistant Examiner*—W. D. Bray
*Attorney, Agent, or Firm*—McGlew and Tuttle

[57] ABSTRACT

There is described a wood shearing machine, for the production of veneers, characterized in that it has the table supporting the wood stock to be cut, as well as the slideways upon which said table slides is inclined at an angle $\alpha$ to the vertical and consequently the bar-carrying unit and the blade-holding unit, which are perpendicular to the former, are inclined at an angle $\alpha'$ to the horizontal; the two angles $\alpha$ and $\alpha'$ being obviously equal to each other, the arrangement being such so as to ensure with the same speed lower stresses and increased speeds than with vertical wood shearing machines.

1 Claim, 2 Drawing Figures

WOOD SHEARING MACHINE FOR THE PRODUCTION OF VENEERS, HAVING THE WOOD-SUPPORTING TABLE INCLINED TO THE VERTICAL

BACKGROUND OF THE INVENTION

1. Object

It is the object of the present Patent Application to provide a wood shearing machine for the production of veneers, having a wood supporting table inclined to the vertical.

2. The Prior Art

It is a revolutionary discovery in the field because in the prior art besides the horizontal or almost horizontal wood shearing machines, only perfectly vertical ones are known. The latter have been devised for the special purpose of imparting to the wood stock a vertical motion, while keeping the blade-holding unit stationary during the operating step.

However, such vertical wood-shearing machines have the drawback of not permitting an easy positioning of the wood stock on the supporting table nor a perfect adhesion of the same to said table, particularly in the operating step during which the wood stock is most likely to suffer the stresses due to the reciprocating motion to which it is subjected and the torques generated by the shearing forces acting on it, which tend to detach it from the table on which it is supported, often with an unstable equilibrium.

Such a drawback leads to considerable complications because, as may be readily understood, the product of such wood-shearing machines may have a thickness which is not desirably constant.

On the other hand, in cases where the wood stock is completely detached from the table on which it is supported, this could lead to a serious danger for the operator and for the machine he is actuating.

SUMMARY OF THE INVENTION

In order to obviate or reduce to a maximum extent such drawbacks, a wood shearing machine of the present invention has been devised. It is characterized by a particular arrangement of its various members which suits the new requirement of having the wood-stock supporting table inclined with respect to the vertical.

More particularly, it has been found that the inclination to be imparted to the wood-stock supporting table is preferably from 10° to 30° to the vertical.

As a result, the whole assembly comprising the blade-holding unit and the bar-carrying unit is disposed on tracks which are not horizontal, but are inclined to the horizontal plane since they have to be perpendicular with respect to the wood stock supporting table. The latter, in turn, must also be slidable with respect to slideways fixed and integral with the structure of the machine during a cutting operation.

The following advantages therefore derive:

(1) The wood stock is easily positioned with suitable positioning means so as to have it supported on both sides simultaneously, instead of on one side only, as with vertical wood shearing machines which therefore gives a stable equilibrium to the wood stock.

(2) The wood stock thus supported may consequently be fixed in a predetermined position with suitable means much more simply than the usual ones used in vertical wood shearing machines.

(3) The wood stock may consequently be cut at a constant thickness as required, while easily maintaining the same position during operation of the wood shearing machine, in spite of the stresses imparted by the inertia forces due to the reciprocating motion to which the wood stock is subjected together with the table supporting it and the torques generated by the actions of the cutting members.

(4) The wood stock by moving to-and-fro downwards or upwards, relative to a stantionary blade carrying unit and bar unit departs from the ground plane by an amount smaller than the one required with vertical wood shearing machines and the stresses of the members imparting to it the motion, are consequently proportionately smaller and therefore also their equilibrium does not suffer.

The motion will therefore be faster, with the same amount of stresses, with an increased production rate.

(5) The vertical stresses due to the inertia forces to which the base of the machine and its bed are subjected, with the same production rate, are obviously lower than those to which a vertical wood shearing machine is subjected. In fact, the inertia forces in this case are divided into vertical and horizontal components.

The accompanying drawings, given by way of example only and without limitation, show in a side view two preferred embodiments of a wood shearing machine according to the invention.

THE VIEWS OF THE DRAWINGS

FIG. 1 shows a wood shearing machine with the bar-carrying unit placed above the blade-holder unit, and FIG. 2 shows a wood shearing machine with the blade-carrying unit placed at the top, the latter solution being the object of another Patent Application Ser. No. 686,679 filed May 17, 1976 by the Applicant.

DETAILED DESCRIPTION OF THE PREFERRED EMBODIMENT

Figure 1:
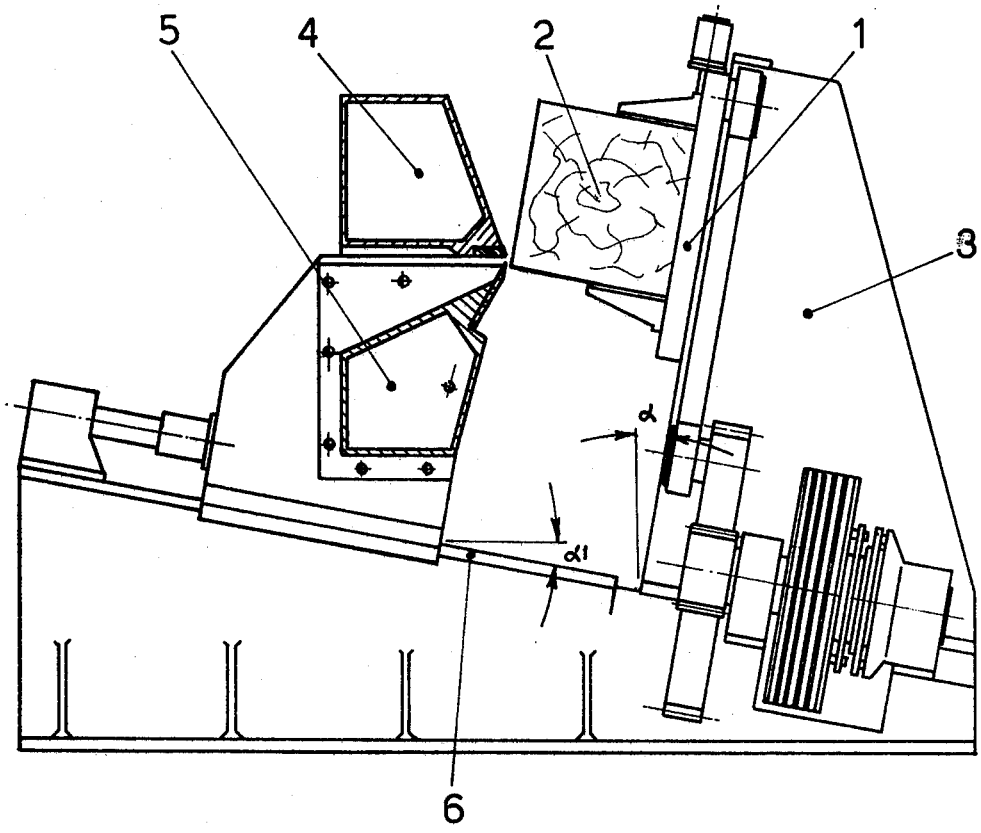
Figure 2:
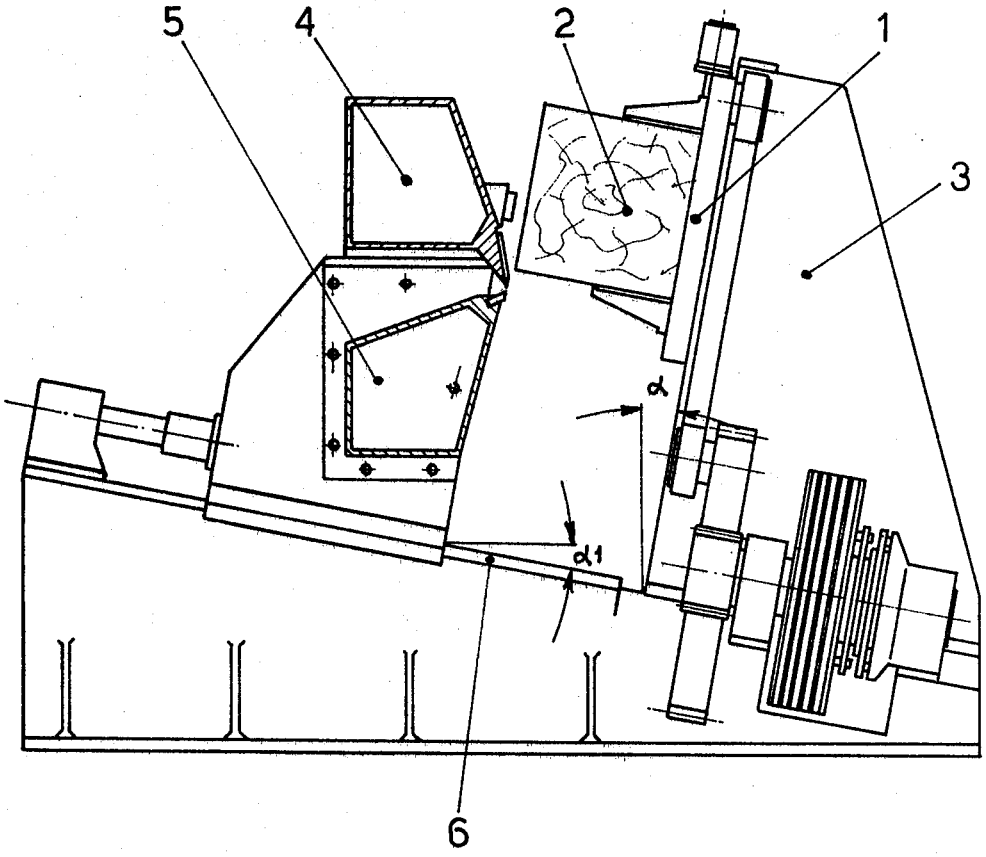

As may be seen from the drawing, the wood shearing machine according to the invention, has the table 1 supporting the wood stock 2 to be cut which is inclined to support the wood stock at an angle $\alpha$ to the vertical and a slideways 3 on which the table 1 slides which is similarly inclined.

The blade-carrying unit and bar-holding unit 4 and 5 are slidable in turn on tracks 6 which track 6 is inclined to the horizontal at an angle $\alpha' = \alpha$ whereby unit 4 and 5 can be fed toward the wood stock after each cut.

The value of angles $\alpha$ and $\alpha'$, as mentioned above, ranges preferably from 10° (as shown in the drawing) up to 30°.

In the embodiments shown, conventional control members for the movable elements e.g., the table and wood stock supported thereon are provided, but as will be readily understood by a person skilled in the art, and which be changed without departing from the scope of the invention.

The means used to fix the wood stock to the supporting table may also be varied and take up various forms differing from the conventional ones shown in the drawings. They will be much more simple than those currently provided in vertical wood shearing machines since they are designed to support the wood stock with the aid of the table with which it slides, instead of supporting it on their own.

I claim:

1. A wood shearing machine for cutting a wood stock into thin wood sheets for use as wood veneers comprising a base frame, a slideway mounted on said frame, a table for supporting a wood stock slidably mounted on said slideway whereby said table and wood stock supported thereon can be reciprocated during a cutting operation, said slideway and woodstock being disposed at an acute angle with respect to the vertical, a track mounted on said frame, a bar carrying unit and blade holding unit slidably mounted on said track for movement toward and away from the supported wood stock for feeding said bar carrying unit and blade holding unit toward and away from said wood stock, said bar carrying unit and blade holding unit being immovable during a cutting operation, said track and bar carrying unit and blade holding unit being disposed at an acute angle with respect to the horizontal, said acute angle of said slideway and wood stock relative to the vertical plane of reciprocation being equal to the acute angle of said blade holding unit relative to said horizontal axis so that the angle of inclination between the wood stock and the blade holding unit is substantially 90°, and said cutting of the wood stock being effected by moving the wood stock in a plane parallel to the inclination of said table relative to the vertical plane of reciprocation and relative to a stationary blade holding unit inclined at said acute angle relative to a horizontal axis whereby the inclination of said table provides for maximum resistance against torque forces acting on said wood stock during a cutting operation to provide for accurate and uniform veneer sheets and whereby the cut veneer sheet can be readily and safely extracted from the stationary blade holding unit, and said acute angle of inclination of said table relative to the vertical plane of reciprocation and the acute angle of inclination of said bar carrying unit and blade holding unit relative to said horizontal axis range between 10° to 30° and being beyond the vertical in a direction away from said track and bar carrying unit and blade holding unit.

* * * * *